US006974355B1

(12) United States Patent
Kuan

(10) Patent No.: US 6,974,355 B1
(45) Date of Patent: Dec. 13, 2005

(54) CONNECTOR

(75) Inventor: Chi-Te Kuan, Shulin (TW)

(73) Assignee: L&K Precision Technology Co., Ltd., Taipei Hsien (TW)

( * ) Notice: Subject to any disclaimer, the term of this patent is extended or adjusted under 35 U.S.C. 154(b) by 95 days.

(21) Appl. No.: 10/895,056

(22) Filed: Jul. 21, 2004

(51) Int. Cl.[7] ..... H01R 13/41
(52) U.S. Cl. ..... 439/733.1; 439/869
(58) Field of Search ..... 439/733.1, 83, 439/686, 78, 869

(56) References Cited

U.S. PATENT DOCUMENTS 5,403,215 A * 4/1995 Buchter et al. ..... 439/869
6,168,477 B1 * 1/2001 Shih et al. ..... 439/733.1
6,302,711 B1 * 10/2001 Ito ..... 439/83
6,454,575 B1 * 9/2002 Jones et al. ..... 439/79
6,491,536 B1 * 12/2002 Torii ..... 439/246

* cited by examiner

*Primary Examiner*—Hien Vu
(74) *Attorney, Agent, or Firm*—Troxell Law Office, PLLC

(57) ABSTRACT

A connector includes an insulative housing and a plurality of terminals received in the receiving holes. The insulative housing includes a first surface, a second surface opposite to the first surface, and third and fourth surfaces connected between the first surface and the second surface. A plurality of receiving holes is defined in the insulative housing extending between the first surface and the second surface. A recess is defined in the third surface thereby forming a partition between the recess and each of the receiving holes. The recess provides an engaging portion of the receiving hole with assembling elasticity. Therefore when each terminal is inserted into the engaging portion of the receiving hole, the engaging portion of the receiving hole is resiliently deformed to receive an interferential portion of the terminal, and engaged with the partition for securely fixing the terminal to the insulative housing thereby preventing the terminal from getting loose.

4 Claims, 3 Drawing Sheets

CONNECTOR

BACKGROUND OF THE INVENTION

1. Field of the Invention

The present invention relates to a connector, and particularly to a connector which includes an insulative housing and a plurality of terminals interferentially received in the insulative housing.

2. Prior Art

In general, a terminal of a connector is assembled to an insulative housing through interferential engagement or integral molding. As to the interferential engagement, the terminal is forced to interferentially extend into and engage with the insulative housing by a tool. As to the integral molding, the terminal is put in a mold and then integrally formed with the insulative housing. When the terminal and the insulative housing is assembled through the interferential engagement, the size of a receiving hole defined in the insulative housing for receiving the terminal is slightly smaller than that of an interferential portion of the terminal. Therefore, the interferential portion of the terminal is forced to insert into and engage with an engaging portion of the receiving hole, which results in damaging the engaging portion and enlarging the size of the engaging portion of the receiving hole.

However, since the engaging portion of the receiving hole is enlarged after assembly and the direction of an inserting force exerted to the terminal by a complementary connector is opposite to the direction along which the terminal is interferentially inserted into the receiving hole, the inserting force may adversely affect the interferential engagement between the interferential portion and the receiving hole and even cause the interferential portion to slide along the receiving hole. Therefore, the terminal is easy to get loose, which adversely affects the electrical connection between the connector and the complementary connector thereby resulting in unstable signal transmission.

SUMMARY OF THE INVENTION

Accordingly, an object of the present invention is to provide a connector which provides assembling elasticity between a terminal thereof and an insulative housing thereof when the terminal is assembled to the insulative housing, thereby preventing the insulative housing from being damaged and so ensuring the securely interferential engagement between the terminal and the insulative housing.

To achieve the above-mentioned object, a connector in accordance with the present invention includes an insulative housing and a plurality of terminals received in the receiving holes. The insulative housing includes a first surface for mating with a complementary connector, a second surface opposite to the first surface, and third and fourth surfaces connected between the first surface and the second surface. A plurality of receiving holes is defined in the insulative housing extending between the first surface and the second surface. A recess is defined in the third surface thereby forming a partition between the recess and each of the receiving holes. Each terminal includes a contact portion, an interferential portion and a connecting portion. The contact portion is formed with a contact surface adjacent to the first surface of the insulative housing. The interferential portion extends from the contact portion. An interferential element is formed at the interferential portion and interferentially engages with the partition. The connecting portion extends from the interferential portion and out of the receiving hole.

The recess of the third surface provides an engaging portion of the receiving hole with assembling elasticity. Therefore when each terminal is inserted into the engaging portion of the receiving hole, the engaging portion of the receiving hole is resiliently deformed to receive the interferential portion, and then the interferential element of the terminal is interferentially engaged with the partition for securely fixing the terminal to the insulative housing thereby preventing the terminal from getting loose.

Other objects, advantages and novel features of the present invention will be drawn from the following detailed embodiment of the present invention with attached drawings, in which:

DESCRIPTION OF THE PREFERRED EMBODIMENT

Figure 1:
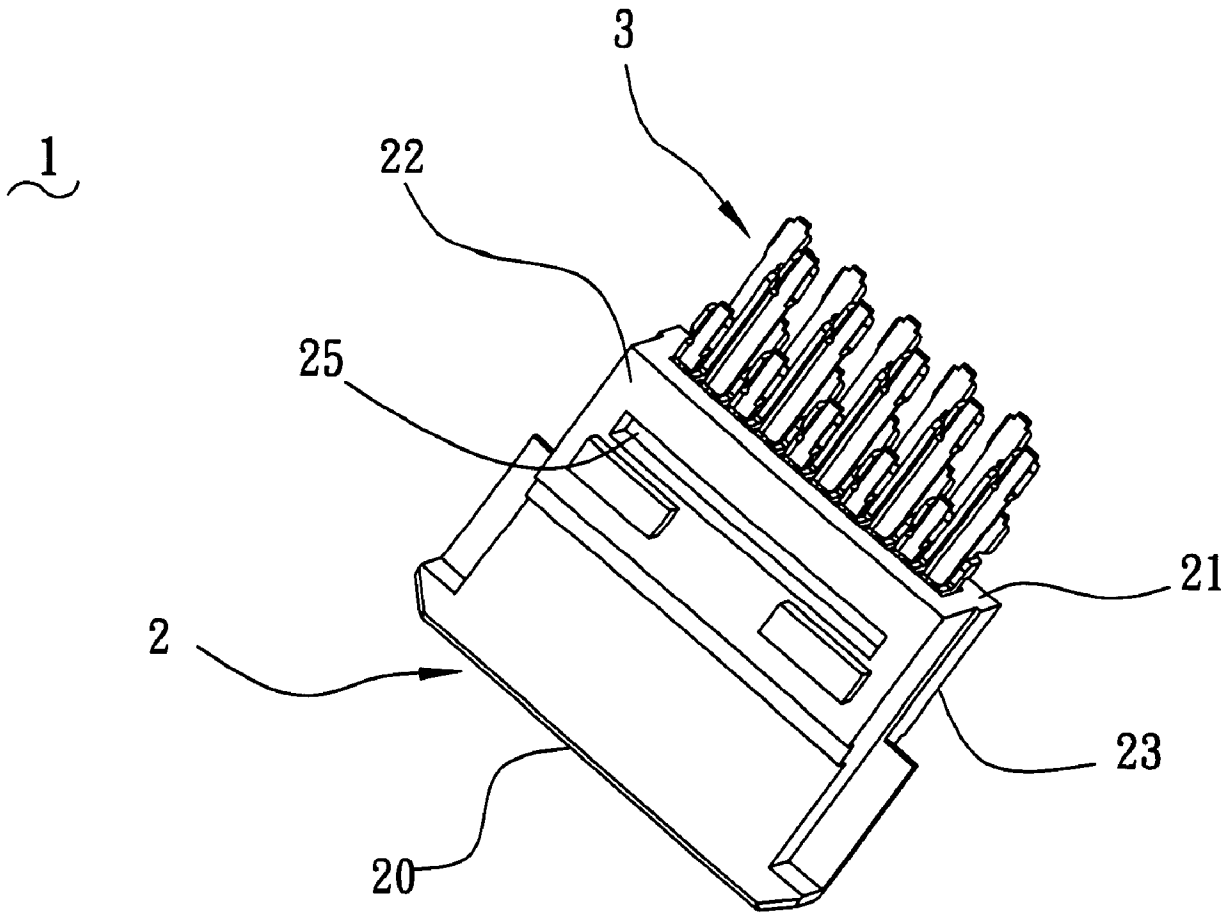
FIG. 1 is a perspective view of a connector of the present invention.
Figure 3:
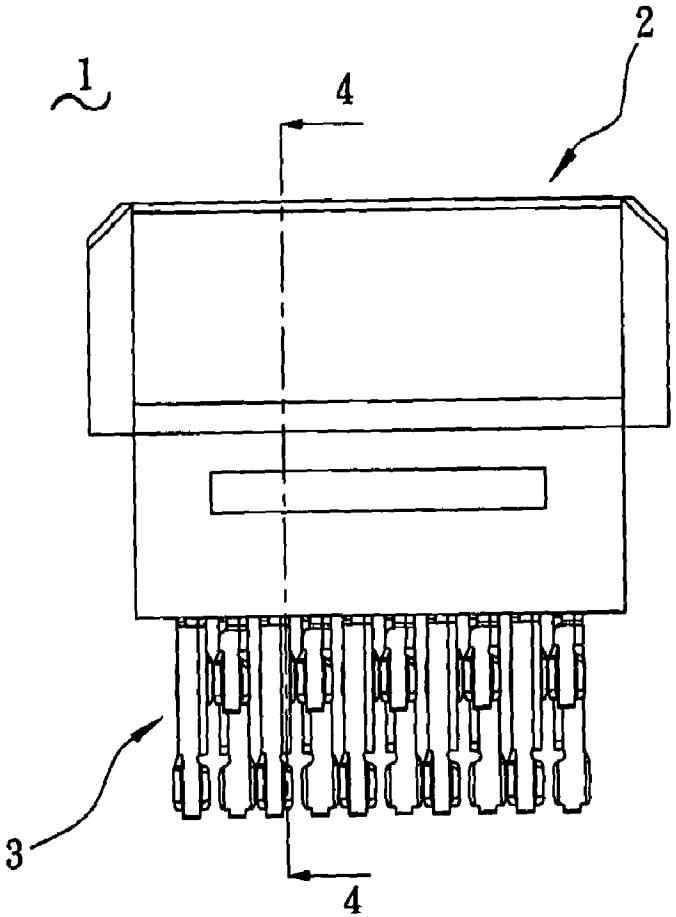
FIG. 3 is a bottom plan view of FIG. 1.
Figure 2:
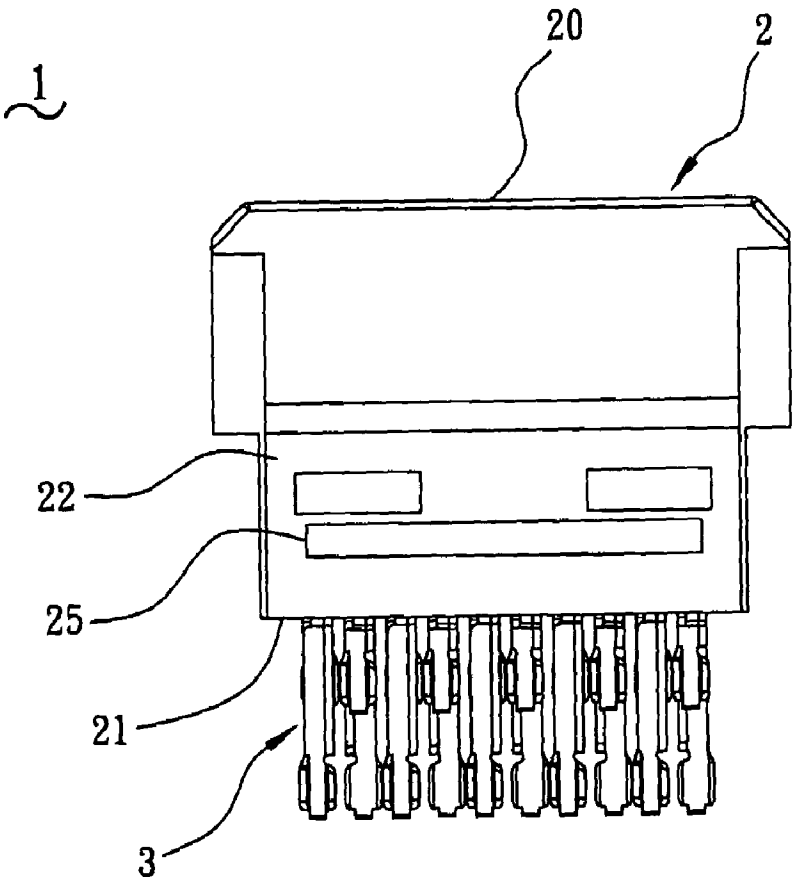
FIG. 2 is a top plan view of FIG. 1.

Referring to FIGS. 1–4, a connector 1 of the present invention includes an insulative housing 2 and a plurality of terminals 3. The insulative housing 2 includes a first surface 20 for mating with a complementary connector (not shown), a second surface 21 opposite to the first surface 20 for insertion of the terminals 3, and third and fourth surfaces 22, 23 connected between the first surface 20 and the second surface 21. A plurality of receiving holes 24 (see FIG. 4) is defined in the insulative housing 2 extending between the first surface 20 and the second surface 21 for receiving the terminals 3 therein. Each receiving hole 24 includes an engaging portion 241 extending from the second surface 21 for insertion of the terminal 3 and interferential engagement with the terminal 3. An elongate recess 25 is defined in the third surface 22 adjacent to the engaging portion 241 of the receiving hole 24 thereby forming a partition between the elongate recess 25 and each of the engaging portions 241 of the receiving holes with the thickness thereof being about 0.2 mm. Therefore, the engaging portion 241 of the receiving hole 24 has elasticity due to the elongate recess 25. When the terminals 3 are inserted into the receiving holes 24, the elongate recess 25 provides buffer area for preventing the terminals 3 from damaging inner walls of the engaging portion 241 and enlarging the size of the engaging portion 241.

The terminals 3 are received in the receiving holes 24. Each terminal 3 includes a contact portion 30, an interferential portion 31 and a connecting portion 32. The contact portion 30 is shaped as a tuning fork and includes a contact surface 301 adjacent to the first surface 20 for electrically contacting a contact of the complementary connector. The interferential portion 31 extending from the contact portion 30 includes an interferential element 310 shaped as a barb for interferentially engaging with the partition of the insulative housing 2. The connecting portion 32 extends from the interferential portion 31 and out of the receiving hole 24 for electrically connecting to a cable or a printed circuit board.

Figure 4:
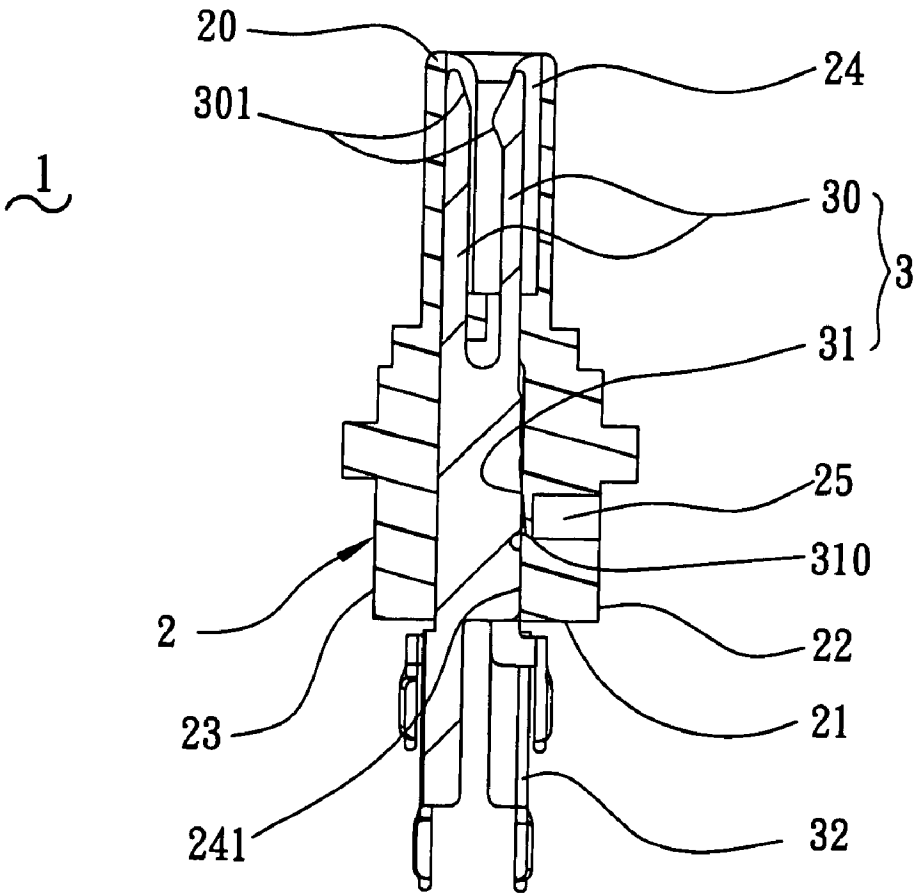
FIG. 4 is a crosssetional view of FIG. 3 taken along line 4—4.

Referring to FIG. 4, the elongate recess 25 of the third surface 22 provides the engaging portion 241 of the receiving hole 24 with assembling elasticity. When the terminal 3 is inserted into the engaging portion 241 of the receiving hole 24, the engaging portion 241 of the receiving hole 24 is resiliently deformed to receive the interferential portion 31 of the terminal 3 due to the assembling elasticity thereof thereby preventing the interferential portion 31 from damaging the engaging portion 241 of the receiving hole 24. After the terminal 3 is positioned in the receiving hole 24, the interferential element 310 of the terminal 3 interferentially engages with the partition and then the partition is pressed by a tool (not shown) for ensuring the interferential engagement between the interferential portion 31 of the terminal 3 and the partition of the insulative housing 2. Thus, the terminals 3 are securely fixed to the insulative housing 2 thereby preventing from getting loose when the connector 1 mates with the complementary connector.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A connector, comprising:

an insulative housing comprising a first surface for mating with a complementary connector, a second surface opposite to the first surface, and third and fourth surfaces connected between the first surface and the second surface, a plurality of receiving holes being defined in the insulative housing extending between the first surface and the second surface, an elongate recess being defined in the third surface thereby forming an elongate partition in the elongate recess along one side of the receiving holes between the recess and each of the receiving holes; and wherein after the terminals are positioned at the receiving holes, the partition is pressed by a tool thereby ensuring the securely interferential engagements between the interferential portions and the partition;

a plurality of terminals received in the receiving holes, each terminal comprising a contact portion, an interferential portion and a connecting portion, the contact portion being formed with a contact surface adjacent to the first surface of the insulative housing, the interferential portion extending from the contact portion, an interferential element being formed at the interferential portion and interferentially engaging with the partition, the connecting portion extending from the interferential portion and out of the receiving hole;

whereby the recess of the third surface provides an engaging portion of the receiving hole with assembling elasticity, so when each terminal is inserted into the engaging portion of the receiving hole, the engaging portion of the receiving hole is resiliently deformed to receive the interferential portion, and then the interferential element of the terminal is interferentially engaged with the partition for securely fixing the terminal to the insulative housing thereby preventing the terminal from getting loose.

2. The connector as claimed in claim 1, wherein the thickness of the partition is about 0.2 mm.

3. The connector as claimed in claim 1, wherein the interferential element of the terminal is shaped as a barb.

4. The connector as claimed in claim 3, wherein the contact portion of the terminal is shaped as a tuning fork.

* * * * *